US007744010B2

(12) United States Patent
Reed

(10) Patent No.: US 7,744,010 B2
(45) **Date of Patent: *Jun. 29, 2010**

(54) RAIL ANCHOR ISOLATOR FOR RAILROAD TIE

(75) Inventor: Martin Earl Reed, Chester, VA (US)

(73) Assignee: Unit Rail Anchor Company, Atchison, KS (US)

( * ) Notice: Subject to any disclaimer, the term of this patent is extended or adjusted under 35 U.S.C. 154(b) by 93 days.

This patent is subject to a terminal disclaimer.

(21) Appl. No.: 12/220,659

(22) Filed: Jul. 28, 2008

(65) Prior Publication Data

US 2010/0019056 A1 Jan. 28, 2010

(51) Int. Cl.
*E01B 9/00* (2006.01)

(52) U.S. Cl. ..... 238/310; 238/321; 238/349; 238/351

(58) Field of Classification Search ..... 238/321, 238/323, 327 R, 327 A, 299, 307, 306
See application file for complete search history.

(56) References Cited

U.S. PATENT DOCUMENTS 1,329,363 A * 2/1920 Bowe ..... 238/264
2,039,181 A * 4/1936 Muller ..... 238/264
3,826,424 A * 7/1974 McClung et al. ..... 238/264
4,561,589 A * 12/1985 Hixson ..... 238/297
4,632,308 A * 12/1986 Fischer ..... 238/265
6,619,558 B1 * 9/2003 Jang ..... 238/283
6,829,871 B1 * 12/2004 McSherry et al. ..... 52/705
7,147,169 B2 * 12/2006 Walsh ..... 238/310
7,374,110 B2 * 5/2008 Walsh ..... 238/351
2006/0196963 A1 * 9/2006 Walsh ..... 238/310
2007/0057081 A1 * 3/2007 Walsh ..... 238/310
2008/0251595 A1 * 10/2008 Reed et al. ..... 238/315

* cited by examiner

*Primary Examiner*—S. Joseph Morano
*Assistant Examiner*—Jason C Smith
(74) *Attorney, Agent, or Firm*—Edward J. Brosius

(57) ABSTRACT

The present invention provides an isolator particularly adapted for use with a rail anchor utilized in an application where railroad rail is installed on concrete ties. The isolator protects the concrete tie from contact with the rail anchor caused by longitudinal movement of the rail due to train acceleration of deceleration or expansion and contraction due to temperature changes. In one embodiment, the isolator is comprised of a structural plastic material and includes a front face section and a rear face section. The front face section and rear face section each comprise a generally rectangular structure, having a top edge, bottom edge, and side edges. Top and bottom sections join the front face section and rear face section and form part of the isolator. The rail anchor also comprises a support section that extends from an intersection of the rear face section with the bottom section. The rail isolator is designed to be embedded in a concrete railroad tie.

12 Claims, 2 Drawing Sheets

RAIL ANCHOR ISOLATOR FOR RAILROAD TIE

BACKGROUND OF THE INVENTION

The present invention relates to an isolator for use with a rail anchor and, more particularly, to an isolator for use with a concrete railroad tie.

In the installation and operation of railroad rail, the standard rail fastener is a spike driven into a wood tie on either side of the rail. Such arrangement is designed to keep the lateral spacing between rails to maintain gauge distance. Tie plates are also utilized as bearing pads against lateral and vertical forces.

Special problems have arisen due to the use of concrete ties in certain railroad rail installations. Certain approaches to restricting and restraining rail used with concrete ties are shown in U.S. Pat. Nos. 5,016,816, 7,147,169 and 7,374,110.

The particular problem with railroad rail mounted on concrete ties is longitudinal rail movement when holding is provided with resilient fasteners. Rail anchors can be used to restrict such longitudinal rail movement, which typically occurs during the acceleration and deceleration of trains or the expansion and contraction due to temperature changes. However, abrasions from the steel rail anchor against the concrete tie tend to erode and eventually damage the concrete tie.

Accordingly, it is an object of the present invention to provide an improved isolator for use with a rail anchor, particularly adapted for use with concrete ties.

SUMMARY OF THE INVENTION

The present invention provides an isolator particularly adapted for use with a rail anchor utilized in an application where railroad rail is installed on concrete ties. The isolator protects the concrete tie from longitudinal movement of the rail due to expansion and contraction due to changing temperatures, and the acceleration and deceleration of trains.

In one embodiment, the isolator is comprised of a structural plastic material and includes a front face section and a rear face section. The front face section and rear face section each comprise a generally rectangular structure, having a top edge, bottom edge, and side edges. A top and a bottom section join the front face section and rear face. A support section extends from an intersection of the rear face section and the bottom section. The rail isolator is designed to be embedded in a concrete railroad tie.

DETAILED DESCRIPTION OF THE INVENTION

Figure 1:
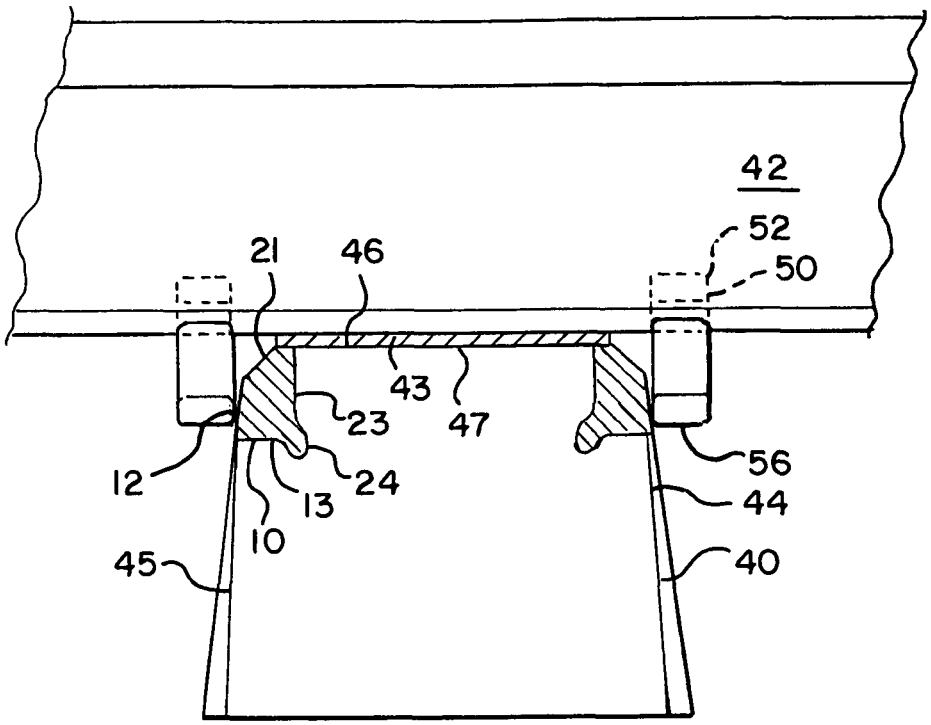
FIG. 1 is an end view, in partial cross-section, of rail anchor isolators installed in a railroad tie in accordance with an embodiment of the present invention.
Figure 2:
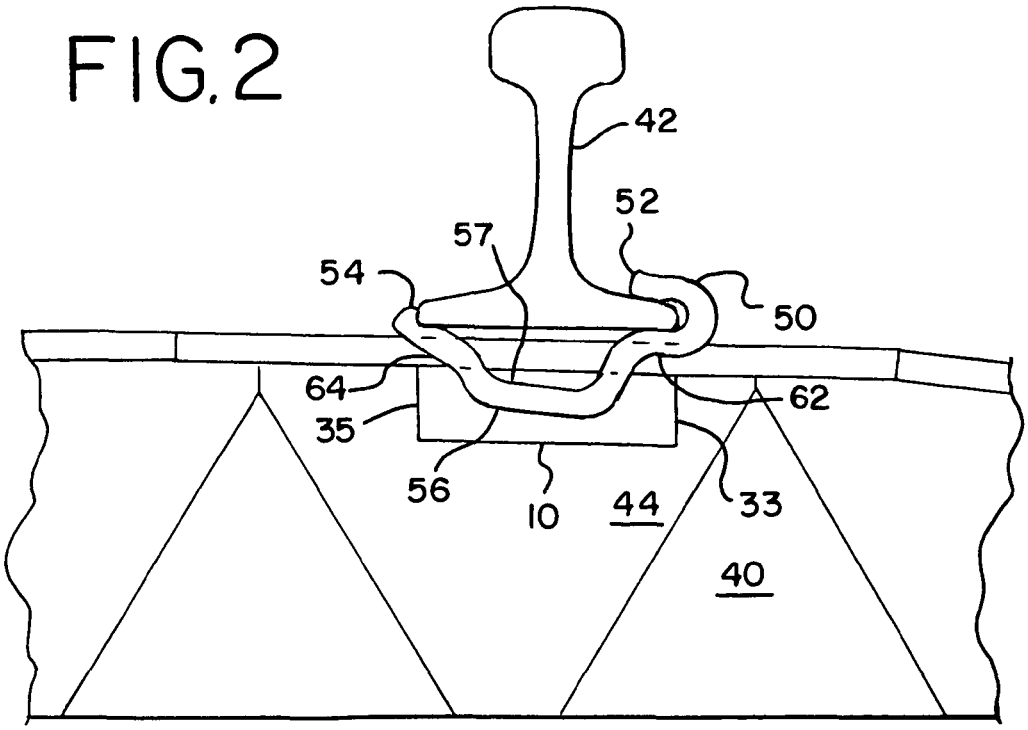
FIG. 2 is an end view of a railroad rail, in partial cross-section, with a rail anchor and rail anchor isolator installed in a railroad tie in accordance with an embodiment of the present invention.
Figure 3:
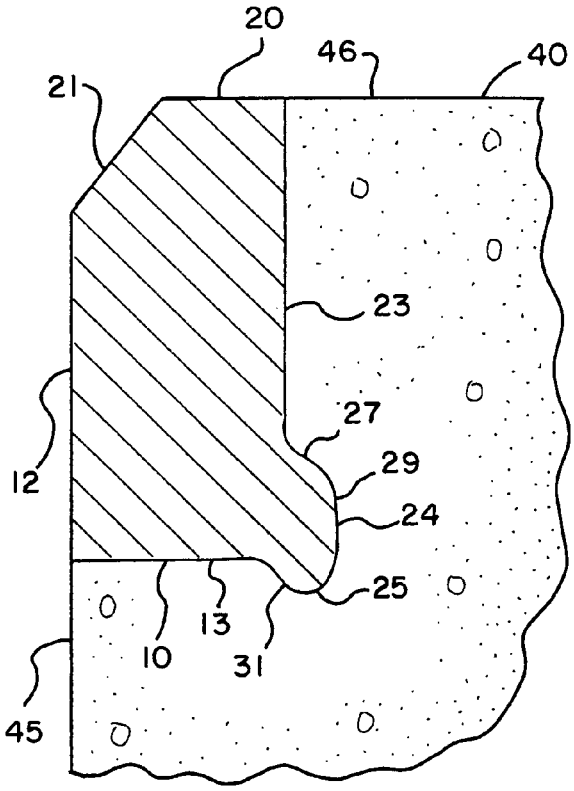
FIG. 3 is a detailed partial cross sectional end view of a rail anchor isolator installed in a railroad tie in accordance with an embodiment of the present invention.
Figure 4:
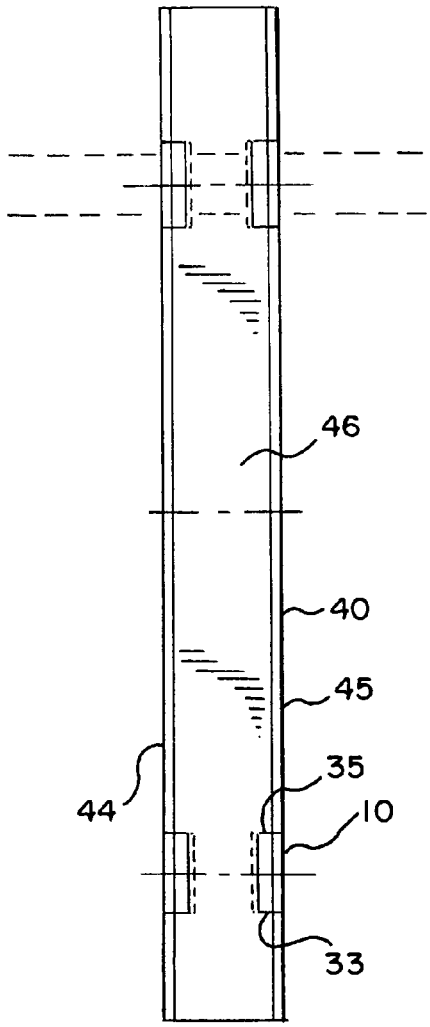
FIG. 4 is a top view of rail anchor isolators and installed in a railroad tie in accordance with an embodiment of the present invention.

Referring now to FIGS. 1-4, a rail anchor isolator is shown generally at 10. Rail anchor isolator 10 is seen to be of a general rectangular shape in cross-section, and is comprised of front face section 12 and rear face section 23. Top section 20 is seen to extend between and join front face section 12 and rear face section 23. Top section 20 also includes an intermediate section 21 that extends at an acute angle from front face section 12 and top section 20. The surfaces of front face section 12 and rear face section 23 are generally planar. Top section 20 is also generally planar, and generally perpendicular to rear face section 23.

Rail anchor isolator 10 also includes two side faces 33 and 35.

Rear face section 23 is seen to be a generally elongated, rectangular structure having a top edge intersecting with top section 20. Rear face section 23 also includes a lower portion which forms part of support section 24. Support section 24 is seen to extend outwardly from rear face section 23, and includes a rounded corner 25. Support section 24 also extends downwardly from bottom section 13. Corner 25 is preferably rounded, but may be of an angular shape as well.

As installed, rail isolator 10 is placed within a top corner of concrete railroad tie 40, which is a generally elongated rectangular structure, having edges 44 and 45, and top surface 46. A railroad rail is shown at 42 which includes a bottom edge or surface 43. A spacer 47 is provided on top 46 of concrete tie 40 to provide a space and support for rail 42.

A rail anchor 50 is shown as comprising a bent, steel structure having a top end 52 extending to a lower end 54. Rail 42 is seen to be received in rail anchor 50 in a usual fashion. Further, rail anchor 50 includes a lower edge 56 with an upper surface 57 which is spaced below and around rail anchor isolator 10; upper surface 57 contacts or abuts center section 20. It is seen that rear face section 23 provides insulation and spacing between concrete tie side 44 and rail anchor 50. Further, rear face rib section 24 is seen to include angle section 26 which is adjacent a similarly angled section 49 of concrete tie 40.

Rail anchor 50 is seen to have intermediate sections 62 and 64 to keep rail anchor 50 in place on rail 42.

It should be understood that rail anchor isolator 10 is a unitary device, usually made in an injection molding operation. The preferred material for rail anchor isolator 10 is a structural plastic, usually comprising about half a high density polyethylene, and about half a low density polyethylene component mix. Rail anchor isolator 10 is typically placed in a mold when concrete tie 40 is being formed by pouring concrete into a mold. Rail anchor isolator 10 is held in concrete railroad tie 40 by the forming of concrete adjacent rear face section 23, bottom section 13, and round support section 24. Support section 24, by extending either beyond rear face section 23 or bottom section 13, or both, is held within concrete railroad tie 40.

Support section 24 itself is comprised of an upper surface 27 that extends at an acute angle downwardly from rear face section 23. Main section 29 extends generally downwardly from upper section 27. Rounded corner 25 forms the intersection between inner section 29 and lower section 31. Lower surface 31 extends from bottom section 13 at an acute angle.

What is claimed is:

1. An isolator for use with a concrete railroad tie, the isolator comprising:

a structure including a front face section and a rear face section, the front face section comprising a generally rectangular structure, having a top edge, bottom edge and two side edges, the rear face section comprising a generally rectangular structure, having a top edge, bottom edge and two side edges, a bottom section that joins the front face section and the rear face section, and a top section, and a support section that extends outwardly and downwardly from an intersection of the rear face section with the bottom section, wherein the support section extends inwardly beyond the rear face section, and wherein the support section extends downwardly beyond the bottom section.

2. The isolator of claim 1 wherein the isolator is a unitary structure comprised of a structural plastic material.

3. The isolator of claim 1 wherein the isolator is comprised of a structural plastic material that is an electrical insulator.

4. The isolator of claim 1 where in the bottom section, the support section, and rear face section and at least a portion of the top section of the isolator are embedded in the concrete railroad tie.

5. An isolator for use with a concrete railroad tie, the isolator comprising:

a front face section and a rear face section, the front face section comprising a generally rectangular structure having a top edge, bottom edge and two side edges, the rear face section comprising a generally rectangular structure having a top edge, bottom edge and two side edges, a bottom section that joins the front face section and the rear face section, and a top section, and a support section that extends downwardly from an intersection of the rear face section with the bottom section, wherein the support section extends inwardly beyond the rear face section, and wherein the support section extends downwardly beyond the bottom section.

6. The isolator of claim 5 wherein the isolator is a unitary structure comprised of a structural plastic material.

7. The isolator of claim 5 wherein the isolator is comprised of a structural plastic material that is an electrical insulator.

8. The isolator of claim 5 wherein the bottom section, the support section, the rear face section and at least a portion of the top section of the isolator are embedded in the concrete railroad tie.

9. An isolator for use with a concrete railroad tie, the isolator comprising;

a front face section and a rear face section, the front face section comprising a generally rectangular structure having a top edge, bottom edge and two side edges, the rear facing section comprising a generally rectangular structure having a top edge, bottom edge and two side edges, a bottom section that joins the front face section and the rear face section, and a top section, and a support section that extends outwardly from an intersection of the rear face section with the bottom section, wherein the support section extends inwardly beyond the rear face section, and wherein the support section extends downwardly beyond the bottom section.

10. The isolator or claim 9 wherein the isolator is a unitary structure comprised of a structural plastic material.

11. The isolator of claim 9 wherein the isolator is comprised of a structural plastic material that is an electrical insulator.

12. The isolator of claim 9 wherein the bottom section, the support section, the rear face section and at least a portion of the top section of the isolator are embedded in the concrete railroad tie.

* * * * *